US010852040B2

(12) United States Patent
Ko et al.

(10) Patent No.: US 10,852,040 B2
(45) Date of Patent: Dec. 1, 2020

(54) LINEAR EXPANDER AND CRYOGENIC REFRIGERATION SYSTEM INCLUDING THE SAME

(71) Applicant: KOREA INSTITUTE OF MACHINERY & MATERIALS, Daejeon (KR)

(72) Inventors: Junseok Ko, Daejeon (KR); Hyo-Bong Kim, Daejeon (KR); Seong-Je Park, Daejeon (KR); Han-Kil Yeom, Daejeon (KR); Yong-Ju Hong, Daejeon (KR); Sehwan In, Daejeon (KR)

(73) Assignee: KOREA INSTITUTE OF MACHINERY & MATERIALS, Daejeon (KR)

( * ) Notice: Subject to any disclaimer, the term of this patent is extended or adjusted under 35 U.S.C. 154(b) by 686 days.

(21) Appl. No.: 14/975,990

(22) Filed: Dec. 21, 2015

(65) Prior Publication Data

US 2017/0023280 A1 Jan. 26, 2017

(30) Foreign Application Priority Data

Jul. 23, 2015 (KR) ..... 10-2015-0104637

(51) Int. Cl.
*F25B 9/06* (2006.01)
*F25B 11/02* (2006.01)
(Continued)

(52) U.S. Cl.
CPC ..... *F25B 9/06* (2013.01); *F01B 7/02* (2013.01); *F01B 11/007* (2013.01); *F01B 23/10* (2013.01); *F25B 11/02* (2013.01)

(58) Field of Classification Search
CPC .. F25B 9/06; F25B 11/02; F01B 23/10; F01B 7/02; F01B 11/007
See application file for complete search history.

(56) References Cited

U.S. PATENT DOCUMENTS 4,457,670 A * 7/1984 Tomson ..... F16N 7/12 417/203
5,775,273 A 7/1998 Beale
(Continued)

FOREIGN PATENT DOCUMENTS

CN 1414244 4/2003
JP 61-210276 9/1986
(Continued)

OTHER PUBLICATIONS

European Patent Office, Extended European Search Report of the European Patent Application No. 16150528.4, dated Feb. 16, 2017.

*Primary Examiner* — Frantz F Jules
*Assistant Examiner* — Webeshet Mengesha
(74) *Attorney, Agent, or Firm* — Lex IP Meister, PLLC

(57) ABSTRACT

Disclosed is a linear expander includes: a body portion including a suction hole through which a fluid having a first pressure flows in, a discharge hole through which the fluid flows out with a second pressure that is lower than the first pressure, and first and second holes connecting an expansion space formed between the suction hole and the discharge hole, a first linear generating portion and a second linear generating portion respectively causing pistons provided in the first hole and the second hole to linearly reciprocate to generate an induced electromotive force with an expansion force generated when the fluid having the first pressure expands to the fluid having the second pressure, a suction valve opening and closing the suction hole, and a discharge valve and closing the discharge hole.

8 Claims, 11 Drawing Sheets

(51) Int. Cl.

| | |
|---|---|
| ***F01B 7/02*** | (2006.01) |
| ***F01B 11/00*** | (2006.01) |
| ***F01B 23/10*** | (2006.01) |

(56) References Cited

U.S. PATENT DOCUMENTS

| | | | | |
|---|---|---|---|---|
| 5,850,111 | A | 12/1998 | Haaland | |
| 6,945,202 | B2 * | 9/2005 | Kaneko | F02B 63/04 123/46 R |
| 7,082,909 | B2 | 8/2006 | Gräf et al. | |
| 7,540,164 | B2 | 6/2009 | Roche et al. | |
| 9,551,219 | B2 | 1/2017 | Howes et al. | |
| 2003/0077192 | A1 * | 4/2003 | Shin | F04B 35/045 417/488 |
| 2005/0109295 | A1 | 5/2005 | Kaneko | |
| 2008/0304979 | A1 * | 12/2008 | Lucas | F04B 43/0054 417/327 |
| 2008/0315775 | A1 | 12/2008 | Kim et al. | |
| 2010/0003145 | A1 * | 1/2010 | Kageyama | F04B 27/1009 417/269 |
| 2011/0219810 | A1 | 9/2011 | Longsworth | |
| 2016/0047243 | A1 | 2/2016 | Van De Loo | |

FOREIGN PATENT DOCUMENTS

| | | |
|---|---|---|
| JP | 02-263060 | 10/1990 |
| JP | 02-298764 | 12/1990 |
| JP | 06-010470 | 2/1994 |
| JP | 2004-020048 | 1/2004 |
| JP | 2005-155345 | 6/2005 |
| JP | 2005-524016 | 8/2005 |
| JP | 2006-144568 | 6/2006 |
| JP | 2013-533427 | 8/2013 |
| KR | 10-0624820 | 9/2006 |
| KR | 10-0809397 | 2/2008 |
| WO | 2003-091556 | 11/2003 |
| WO | 2012-013978 | 2/2012 |
| WO | 2014/000013 | 1/2014 |

* cited by examiner

LINEAR EXPANDER AND CRYOGENIC REFRIGERATION SYSTEM INCLUDING THE SAME

CROSS-REFERENCE TO RELATED APPLICATION

This application claims priority to and the benefit of Korean Patent Application No. 10-2015-0104637 filed in the Korean Intellectual Property Office on Jul. 23, 2015, the entire contents of which are incorporated herein by reference.

BACKGROUND OF THE INVENTION

(a) Field of the Invention

The present invention relates to a linear expander, and more particularly, it relates to a linear expander having a simple structure and that can operate with a high frequency and can be used at a cryogenic temperature, and a cryogenic refrigeration system including the linear expander.

(b) Description of the Related Art

A reverse Brayton system operates with processes of compression, cooling, expansion and heating, and generates refrigeration work by adiabatic expansion of working gas. An adiabatic expansion can acquire a more significant cooling effect compared to Joule-Thomson expansion, because a high pressure gas works to the outside during expansion process. However, a sophisticated mechanical device of expander is required for adiabatic expansion.

Currently, a cryogenic temperature expander operated at a cryogenic temperature is broadly classified into a reciprocating expander and a turbo expander.

A conventional reciprocating expander discharges the generated expansion work to the outside through a process of changing a linear motion to a rotational motion using a crank, a cam, and the like. However, the reciprocating expander is large in size and operation frequency is as low as several Hertz. Further, the reciprocating expander has a structure in which a crank is connected between the inside and the outside of the expander such that noise and vibration are generated, and is inefficient because leakage and thermal losses occur due to internal and external temperature and pressure differences.

A turbo expander using an impeller that rotates with at an extremely high speed has an excellent efficiency, but it has been facing a technical barrier because the expander requires a bearing technology sufficiency to support the impeller that rotates with at a speed as high as several kilohertz.

Thus, the present invention suggests a new expander that can solve the low efficiency and generation of noise and vibration problems of the reciprocating expander in and can solve the problem of the turbo expander, which is the high technical barrier.

The above information disclosed in this Background section is only for enhancement of understanding of the background of the invention and therefore it may contain information that does not form the prior art that is already known in this country to a person of ordinary skill in the art.

SUMMARY OF THE INVENTION

In one aspect, the present invention has been made in an effort to provide a linear expander that can structurally offset vibration and noise caused from piston movement by moving pistons combined to two linear generators symmetrically provided in a body portion where a suction valve and a discharge valve are respectively provided to bilaterally opposite directions.

Further, the present invention provides a linear expander, particularly, a linear expander having a simple-structured piston by having a structure in which a fluid flows in and out through a body portion regardless of a movement direction of a piston.

In addition, the present invention provides a linear expander that can reduce energy loss caused by internal and external temperature and pressure differences of the expander by changing energy generated from expansion to electrical energy using linear generators provided in a completely closed and sealed housing.

In another aspect, the present invention provides a cryogenic refrigeration system including the linear expander.

In the following detailed description, only certain exemplary embodiments of the present invention have been shown and described, simply by way of illustration. As those skilled in the art would realize, the described embodiments may be modified in various different ways, all without departing from the spirit or scope of the present invention.

A linear expander according to an exemplary embodiment of the present invention includes: a body portion including a suction hole through which a fluid having a first pressure flows in, a discharge hole through which the fluid flows out with a second pressure that is lower than the first pressure, and first and second holes connecting an expansion space formed between the suction hole and the discharge hole; a first linear generating portion and a second linear generating portion respectively causing pistons provided in the first hole and the second hole to linearly reciprocate to generate an induced electromotive force with an expansion force generated when the fluid having the first pressure expands to the fluid having the second pressure; a suction valve opening and closing the suction hole; and a discharge valve and closing the discharge hole.

The first hole and the second hole may be symmetrical to each other on the same straight line with respect to the expansion space, and the first linear generating portion and the second linear generating portion may be provided symmetrically to each other in the lateral sides of the body portion.

The suction valve and the discharge valve may be set to be in a normally open state.

The suction valve may be closed to prevent inflow of the fluid having the first pressure when a pressure in the expansion space is reduced and thus a pressure difference between the outside of the suction hole and the expansion space is greater than a predetermined value, and the discharge valve may be opened to let the fluid in the expansion space to flow out when the pressure in the expansion space is reduced and thus a pressure difference between the outside of the discharge hole and the expansion space is lower than a predetermined value.

Further, the suction valve and the discharge valve may be respectively formed as reed valves.

The body portion may include a body member having the expansion space. And the linear expander may further include an discharge hole connection member combined with the body member to form a space between the expansion space and the discharge hole of the body portion and having a through-hole through which a fluid having flowed out from the discharge hole flows out, wherein the discharge valve is provided at the end of the through-hole.

The discharge valve may include a stopper portion stopping the end of the through-hole that faces the expansion space; and reed portions connected to the stopper portion and providing an elastic force to close and open the stopper portion by a pressure difference between a front side and a rear side of the stopper portion.

The suction valve may include: a stopper portion stopping the suction hole; and reed portions connected to the stopper portion and providing an elastic force to close and open the stopper portion by a pressure difference between a front side and a rear side of the stopper portion.

Each of the first linear generating portion and the second linear generating portion may preferably include: the piston; a cylinder inserted to the first hole or the second hold formed in the body portion to provide a movement path of the piston; and a linear generator generating an induced electromotive force by movement of the piston.

Each of the first linear generating portion and the second linear generating portion may preferably further include an elastic member provided at a rear end of a piston connection member that connects an operator of the linear generator and the piston to make the operator move according to movement of the piston.

Further, the suction hole and the discharge hole may be preferably respectively provided in a direction perpendicular to a straight line direction along which the piston moves.

The linear expander may further include a housing fixed to an outer side of the body portion and closing and sealing the inside while surrounding the first linear generating portion and the second linear generating portion.

A cryogenic refrigeration system according to an exemplary embodiment of the present invention may cool a cooling target by circulating refrigerant capable of heat transfer. The cryogenic refrigeration system includes: a compressor compressing the gaseous refrigerant, an aftercooler fluidly communicating with an outlet of the compressor, the aftercooler removing compression heat generated during compressing the refrigerant, a cryogenic heat exchanger fluidly communicating with an outlet of the aftercooler, the cryogenic heat exchanger transferring the heat of the refrigerant passing through the aftercooler to the refrigerant flowing into the compressor, a linear expander fluidly communicating with an outlet of the cryogenic heat exchanger, the linear expander receiving and expanding the refrigerant passing through the cryogenic heat exchanger, and a heat exchanger fluidly communicating with an outlet of the linear expander and an inlet of the cryogenic heat exchanger, and contacting with the cooling target, the heat exchanger transferring heat from the cooling target to the refrigerant.

According to the linear expander of the present invention, the respective pistons are moved to in bilaterally opposite directions in the two linear generators symmetrically provided in the body portion to thereby structurally offset vibration and noise caused from piston movement.

In addition, since the fluid can flow in and out through the body portion regardless of the movement direction of the piston, the structure of the piston can be very simple.

Further, energy generated from expansion can be changed to electrical energy by the linear generators provided in the housing so that an energy loss due to temperature and pressure differences can be reduced.

Further, electrical energy generated by the linear generators can be used as an energy source of other devices such as a compressor and the like.

DETAILED DESCRIPTION OF THE EMBODIMENTS

Figure 1:
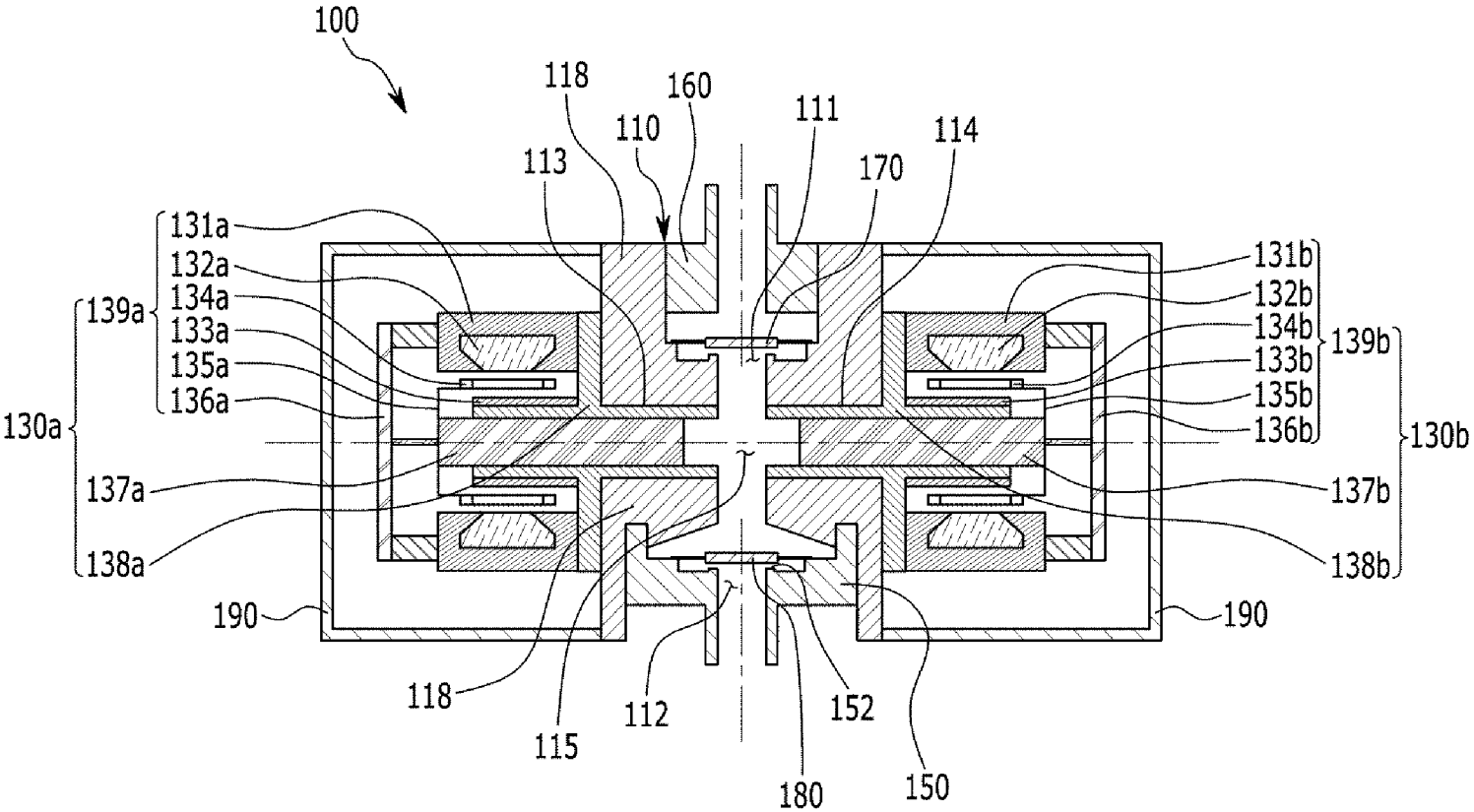
FIG. 1 is a cross-sectional view of a linear expander according to an exemplary embodiment of the present invention.

The present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention. The drawings and description are to be regarded as illustrative in nature and not restrictive. Like reference numerals designate like elements throughout the specification. In addition, the size and thickness of each configuration shown in the drawings are arbitrarily shown for better understanding and ease of description, but the present invention is not limited thereto.

In addition, unless explicitly described to the contrary, the word "comprise" and variations such as "comprises" or "comprising", will be understood to imply the inclusion of stated elements but not the exclusion of any other elements.

Further, in exemplary embodiments, since like reference numerals designate like elements having the same configuration, a first exemplary embodiment is representatively described, and in other exemplary embodiments, only a configuration different from the first exemplary embodiment will be described.

Hereinafter, a linear expander according to an exemplary embodiment of the present invention will be described with reference to the accompanying drawings.

FIG. 1 is a cross-sectional view of a linear expander according to an exemplary embodiment of the present invention.

A linear expander 100 according to an exemplary embodiment of the present invention includes a body portion 110 having a through-out expansion space provided for a fluid to pass, first and second linear generating portions 130*a* and 130*b* respectively connected to lateral sides of the body portion 110 and thus connected with the an expansion space 115, and suction and discharge valves 170 and 180 respectively provided in front and rear sides of the expansion space 115 along a liquid passage direction.

The body portion 110 includes a suction hole 111 through which an external high-pressure fluid flows into the linear expander 100 and a discharge hole 112 flowing a low-pressure fluid of which a pressure is decreased due to expansion to the outside of the linear expander 110, and the expansion space 115 is disposed between the suction hole 111 and the discharge hole 112. A first hole 113 and a second hole 114 are provided at lateral sides of the body portion 110, and they are opened and communicated with the expansion space 115. Two pistons 137*a* and 137*b* may linearly reciprocate along the first and second holes 113 and 114. More specifically, cylinders 138*a* and 138*b* are respectively inserted into the first and second holes 113 and 114 provided in the body portion 110, and the pistons 137*a* and 137*b* are respectively inserted into the cylinders 138*a* and 138*b* such that the pistons can linearly reciprocate.

In this case, the first hole 113 and the second hole 114 of the body portion 110 are connected with the expansion space 115 between the suction hole 111 and the discharge hole 112 in order to let the pistons 137*a* and 137*b* move by an expansion force of the fluid in the expansion space 115, and the first hole 113 and the second hole 114 may be symmetrical to each other on the same straight line with respect to the expansion space 115.

In addition, the shape of the body portion 110 may be horizontally symmetrical to each other with respect to the expansion space 115 as shown in FIG. 1, but this is not restrictive. Further, the suction hole 111 and the discharge hole 112 are respectively disposed in a direction that is perpendicular to the straight line direction along which the pistons 137*a* and 137*b* reciprocate to thereby allow the fluid to pass.

The body portion 110 may further include a discharge hole connection member 150 provided for forming a discharge valve 180 and an inflow connection member 160 that guides an external high-pressure fluid to the suction hole 111, and in the present exemplary embodiment, the discharge hole connection member 150 and the inflow connection member 160 are combined to a body member 118 such that the body portion 110 is formed.

The first linear generating portion 130*a* and the second linear generating portion 130*b*, each having the same configuration, are respectively provided in lateral sides of the body portion 110 in a symmetrical manner. The pistons 137*a* and 137*b* of the first and second linear generating portions 130*a* and 130*b* linearly reciprocate to the opposite directions respectively in the first hole 113 and the second hole 114 to generate an induced electromotive force by a force generated from expansion of the fluid in the expansion space 115 of the body portion 110. When a high-pressure gas flows into the expansion space 115 which is partitioned into the suction hole 111, the discharge hole 112, and the two pistons 137*a* and 137*b*, the high-pressure gas expands and moves the pistons 137*a* and 137*b* to thereby generate the induced electromotive force and the fluid of which the pressure is reduced flows out to the outside of the expansions space 115, and such a process is repeated. A detailed operation of the linear expander 100 according to the exemplary embodiment of the present invention will be described later with reference to FIG. 4A to FIG. 5D.

The first linear generating portion 130*a* and the second linear generating portion 130*b* may respectively include the pistons 137*a* and 137*b*, the cylinders 138*a* and 138*b*, and linear generators 139*a* and 139*b*.

Referring to FIG. 1, the cylinders 138*a* and 138*b* formed in a shape that partially includes a cylindrical portion are inserted into the first hole 113 and the second hole 114 of the body portion 110, and the pistons 137*a* and 137*b* are inserted into the cylindrical portion and thus are guided to perform a reciprocation motion. The linear generators 139*a* and 139*b* may be formed of inner stators 133*a* and 133*b*, outer stators 131*a* and 131*b* where coils 132*a* and 132*b* are wound while having a gap from the inner stators 133*a* and 133*b*, and operators 134*a* and 134*b* formed of permanent magnets. When the pistons 137*a* and 137*b* move by the force generated from expansion of the fluid in the expansion space 115, the operators 134*a* and 134*b* connected with the pistons 137*a* and 137*b* by the piston connection members 135*a* and 135*b* may also linearly move along with the movement of the pistons 137*a* and 137*b*. In this case, as the operators 134*a* and 134*b*, which are permanent magnets, linearly move, an induced electromotive force may be generated in the coils 132*a* and 132*b* provided in the outer stators 131*a* and 131*b*.

In order to satisfy resonance motion of the pistons 137*a* and 137*b* and support the pistons 137*a* and 137*b*, elastic members 136*a* and 136*b* may be connected to rear ends of the piston connection members 135*a* and 135*b* that connect the above-stated operators 134*a* and 134*b* and the pistons 137*a* and 137*b*. In this case, the elastic members 136*a* and 136*b* may be formed as flat-shaped springs or coil springs.

When the linear expander 100 according to the exemplary embodiment of the present invention is used at a cryogenic temperature, the operator 134*a* and 134*b* may provide spring stiffness with magnetic springs thereof rather than using the metallic elastic members 136*a* and 136*b*.

The suction valve 170 closes and opens the suction hole 111 to allow the external high-pressure fluid to flow into the expansion space 115 of the body portion 110 through the suction hole 111. The discharge valve 180 closes and opens the discharge hole 112 to allow the fluid of which pressure is reduced in the expansion space 115 of the body portion 110 to flow to the outside through the discharge hole 112.

In the linear expander 100 according to the exemplary embodiment of the present invention, an external pressure of the suction hole 111 is always higher than an internal pressure of the expansion space 115, and an external pressure of the discharge hole 112 is always set to be lower than the pressure of the expansion space 115. In this case, the suction valve 170 and the discharge valve 180 may be set to be in a normally open state.

In the normally open state, the suction valve 170 is being opened even through if the external pressure is high and then is closed at the moment that the pressure of the fluid in the expansion space 115 is decreased, and thus an internal and external pressure difference becomes greater than a predetermined value instance to thereby prevent an external high-pressure fluid of the suction hole 111 from flowing into the expansion space 115. Further, in the normally open state, the discharge valve 180 is being in the closed state because an external pressure difference between the expansion space 115 and the discharge hole 112 is high, and then is opened when the pressure difference between the outside of the discharge hole 112 and the expansion space 115 is decreased to be lower than a predetermined value as the pressure of the expansion space 115 is decreased due to expansion to thereby allow the fluid in the expansion space 115 to flow to the outside through the discharge hole 112. The predetermined value of the pressure difference between the outside of the suction hole 111 and the expansion space 115 may be equal to or different from the predetermined value of the pressure difference between the outside of the discharge hole 112 and the expansion space 115. The predetermined values of the pressure difference may be set by designing shapes and sizes of the suction valve 170 and the discharge valve 180 for assembling and processing.

Here, the term, "normally open" implies a structure in which a valve is opened when no external force is applied and closed when a pressure force from a pressure difference becomes greater than a predetermined value. In the present exemplary embodiment, the suction valve 170 and the discharge valve 180 are passive valves, and a desired condition can be acquired by designing sizes of the valve for processing and assembling.

The suction valve 170 and the discharge valve 180 may be formed as electric valves that receive a signal according to an internal pressure of the expansion space 115 or a location of the pistons 137*a* and 137*b* and thus being opened or closed by an electrical signal, and may be formed as mechanical valves that can be automatically opened or closed according to a pressure difference between the inside and the outside of the expansion space 115.

Hereinafter, an example of the suction valve 170 and the discharge valve 180 formed as mechanical valves will be described with reference to FIG. 2 and FIG. 3.

Figure 2:
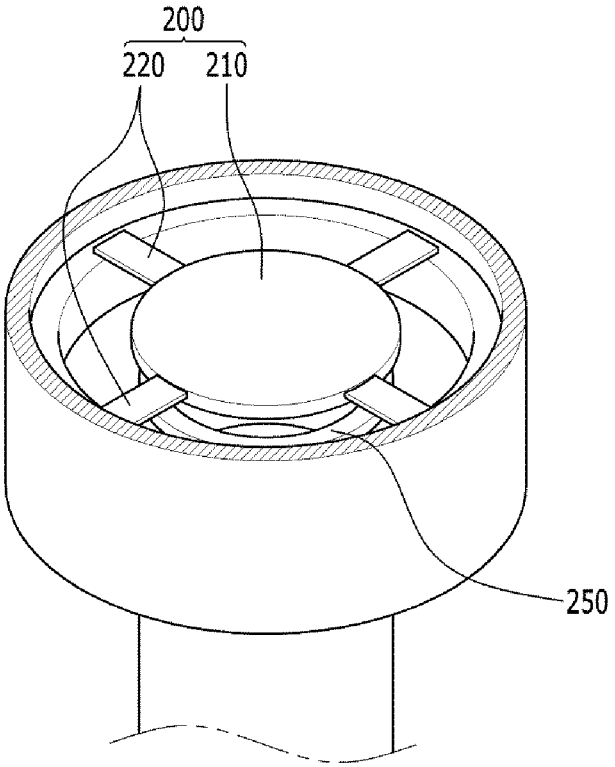
FIG. 2 is a perspective view of normally open structure of a reed valve that can be applied as an inflow value or a discharge valve in the linear expander according to the exemplary embodiment of the present invention.
Figure 3:
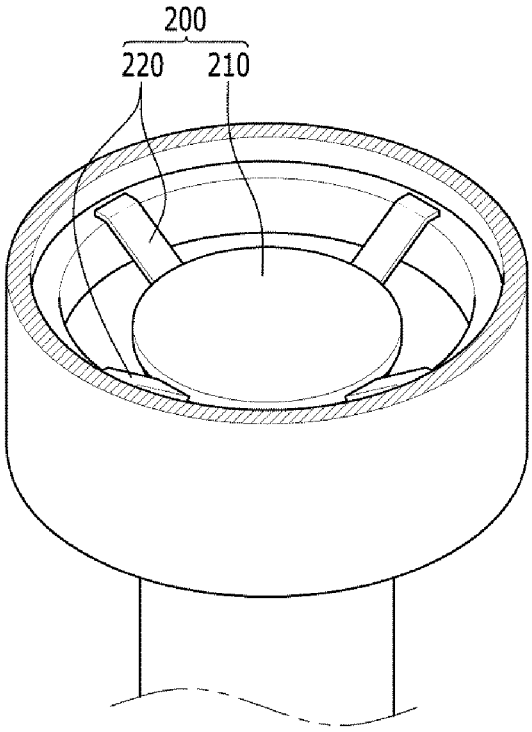
FIG. 3 is a perspective view of the reed value FIG. 2 in a closed state according to an increase of a pressure difference.

FIG. 2 is a perspective view of a normally open structure of a reed valve that can be applied as the suction valve or the discharge valve of the linear expander according to the exemplary embodiment of the present invention, and FIG. 3 is a perspective view of the reed valve of FIG. 2 in a closed state.

As the suction valve 170 or the discharge valve 180 that is automatically opened/closed according to an internal and external pressure difference, a reed valve 200, which is a mechanical valve, may be used, and FIG. 2 exemplarily illustrates the reed valve 200. The reed valve 200 may be formed by including a stopper portion 210 and reed portions 220. The stopper portion 210, formed in a shape of a plate, is separated by a predetermined distance from an opening 250 to allow the flow to flow into or flow out through the opening 250, and when a pressure difference is increased, the stopper portion 210 covers the opening 250 where the fluid flows to thereby prevent the fluid from flowing. In this case, a portion of the stopper portion 210, contacting the opening 250, may be made of a polymer material for sealing, and for example, a material such as Rulon, Kapton, and the like may be used. The reed portions 220 are elastic members that fix the stopper portion 210 to the body portion 110, and move the stopper portion 210 by an elastic force according to a pressure difference between a front side and a rear side of the stopper portion 210 to close/open the opening portion 250 where the fluid flows.

In FIG. 2, although a pressure of the front side of the stopper portion 210 is significantly greater than a pressure of the rear side, which is the bottom of the stopper portion 210, a pressure difference is low and thus the reed valve 200 is opened. In FIG. 3, the pressure difference between the front side and the rear side is increased and thus the reed valve 200 is closed. As described above, in the linear expander 100 according to an exemplary embodiment of the present invention, a valve having a normally open structure is applied as the suction valve 170 and the discharge valve 180, and thus the valve is being opened even through an external pressure is greater than an internal pressure and is opened when an external and internal pressure difference becomes greater than a predetermined value.

Hereinabove, the example of the mechanical valve applied as the suction valve and the discharge valve of the linear expander according to the exemplary embodiment of the present invention has been described with reference to FIG. 2 and FIG. 3, and but any valve that can be automatically opened and closed by a pressure difference is applicable.

Referring back to FIG. 1, the linear expander 100 may further include the above-stated discharge hole connection member 150 for forming the discharge valve 180. The discharge hole connection member 150 has a through-hole through which the fluid flows through the discharge hole 112, and may have a stepped shape to form a separated space between the discharge hole 112 and the expansion space 115 by being combined with the body member 118. In this case, a protrusion 152 may be formed at the end of the discharge hole 112 that faces the expansion space 115, and the protrusion 152 protrudes toward the discharge valve 180 to limit a movement range of the discharge valve 180. The discharge valve 180 that can be automatically opened and closed can be easily installed in the body portion 110 by installing the discharge valve 180 in the discharge hole connection member 150 and then combining the discharge hole connection member 150 back to the body member 118.

Likewise, the suction valve 170 may be formed in the suction hole 111 provided in the body portion 110 as shown in FIG. 1, and in this case, the linear expander 100 may further include the suction hole connection member 160 that guides the fluid to the suction hole 111 from the outside.

A housing 190 is fixed to an outer side of the body portion 110, and the housing may close and seal the inside while surrounding the first linear generating portion 130*a* and the second linear generating portion 130*b*.

In the present exemplary embodiment, when the pistons 137*a* and 137*b* horizontally move due to expansion of the fluid in the expansion space 115, the pistons 137*a* and 137*b* move in opposite directions respectively at the bilateral sides of the expansion space 115 with the same speed, and accordingly, vibration generated from each of the left and right pistons 137*a* and 137*b* can be structurally offset to with each other.

In addition, since the fluid flows in or out through the body portion 110 regardless of the movement directions of the pistons 137*a* and 137*b*, the structure of the linear expander 100 can be simplified and especially the pistons 137*a* and 137*b* may have a simple structure.

Further, when work energy is generated from the linear generators 130*a* and 130*b* provided in the housing 190, an energy loss due to a leakage and heat transmission caused by internal and external temperature and pressure differences of the housing 190 can be reduced.

Hereinafter, an operation of the linear expander 100 according to the exemplary embodiment of the present invention will be described with reference to FIG. 4A, 4B, and FIG. 5A to FIG. 5D.

Figure 4A:
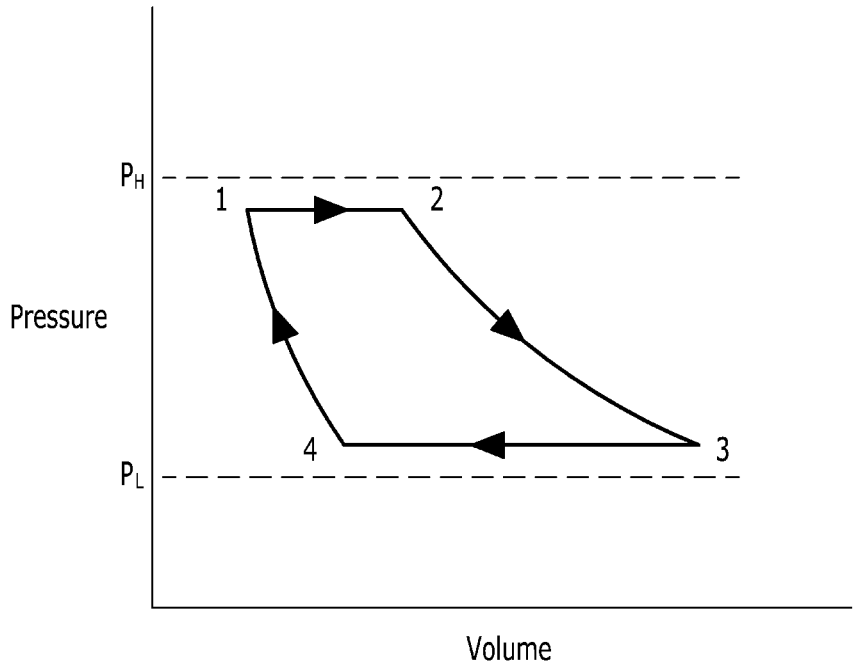
FIG. 4A is shows a pressure-volume (p-v) line indicating operation of the linear expander according to the exemplary embodiment of the present invention.
Figure 4B:
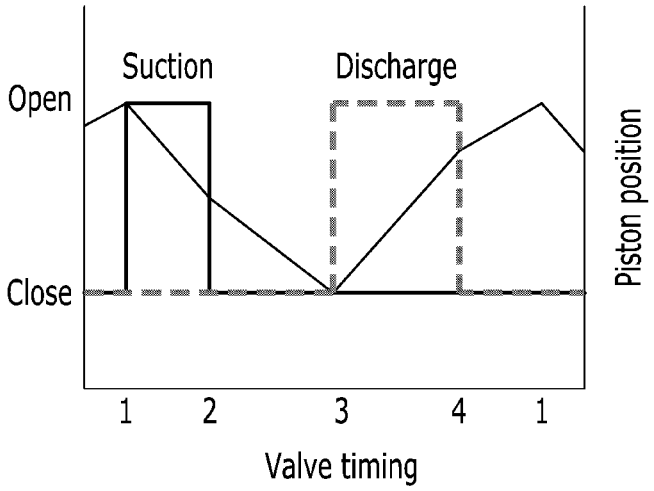
FIG. 4B is a graph illustrating valve open/close timing and a piston location according to the operation of the linear expander according to the exemplary embodiment of the present invention.

FIG. 4A is a pressure-volume diagram (i.e., a p-v diagram) indicating operation of the linear expander according to the exemplary embodiment of the present invention, and FIG. 4B is a graph illustrating a valve open/close timing and piston locations according to operation of the linear expander according to the exemplary embodiment of the present invention. The linear expander 100 according to the exemplary embodiment of the present invention may operate an isobaric suction process between points 1 and 2 in the p-v diagram, an adiabatic expansion process between points 2 and 3, an isobaric discharge process between points 3 and 4, and an adiabatic compression process between points 4 and 1 within one cycle, and as the cycle is being repeated, the high-pressure fluid flowing in through the suction hole 111 expands with low pressure such that the low-pressure fluid can be continuously flows out through the discharge hole 112.

In addition, referring to FIG. 4B, the suction valve 170 (refer to the solid line in FIG. 4B) maintains an opened state during the isobaric suction process and the discharge valve 180 (refer to the broken line in FIG. 4B) maintains a closed state between points 1 and 2, and the pistons 137*a* and 137*b* move to the outside while being gradually distanced from each other. In the adiabatic expansion process between points 2 and 3, the suction valve 170 and the discharge valve 180 maintain the closed state, and the pistons 137*a* and 137*b* move to the outside while being continuously distanced from each other. In the isobaric discharge process between points 3 and 4, the suction valve 170 maintains the closed state and the discharge valve 180 maintains the opened state, and the pistons 137*a* and 137*b* move to the inside while being closer to each other. In the adiabatic compression process between points 4 and 1, the suction valve 170 and the discharge valve 180 maintain the closed state and the pistons 137*a* and 137*b* move to the inward while being continuously closer to each other.

Figure 5A:
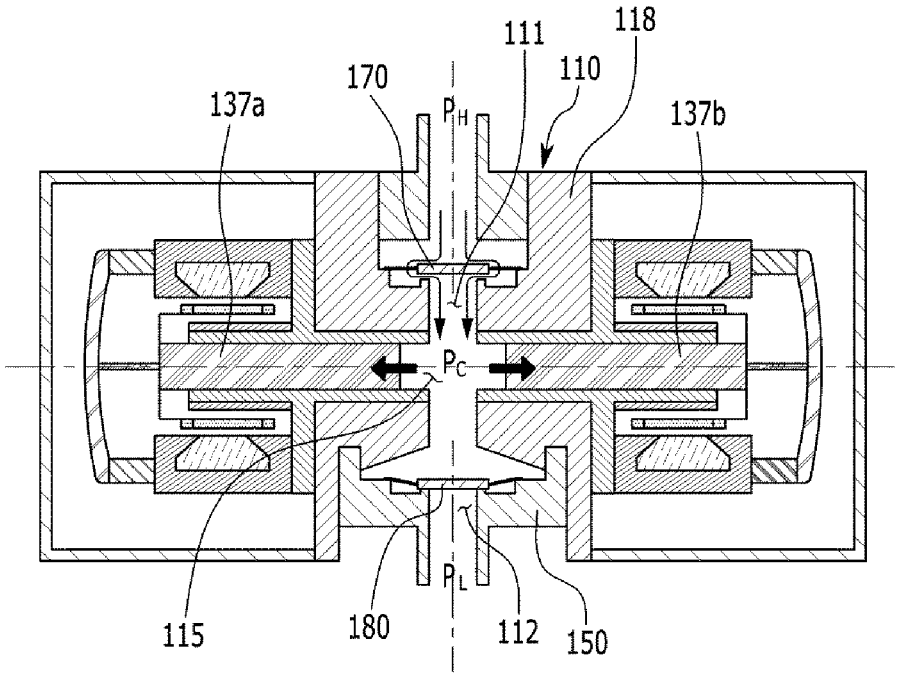
FIG. 5A is a cross-sectional view illustrating the linear expander according to the exemplary embodiment of the present invention in an isobaric suction process from point 1 to point 2 in the p-v line of FIG. 4A.
Figure 5B:
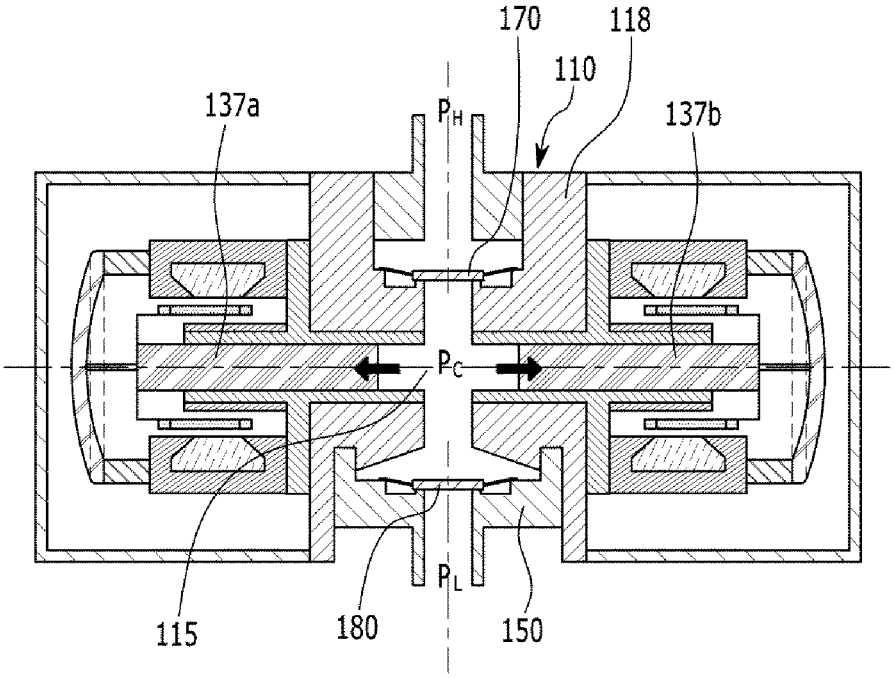
FIG. 5B is a cross-sectional view illustrating the linear expander according to the exemplary embodiment of the present invention in an adiabatic expansion process from point 2 to point 3 in the p-v line of FIG. 4A.
Figure 5C:
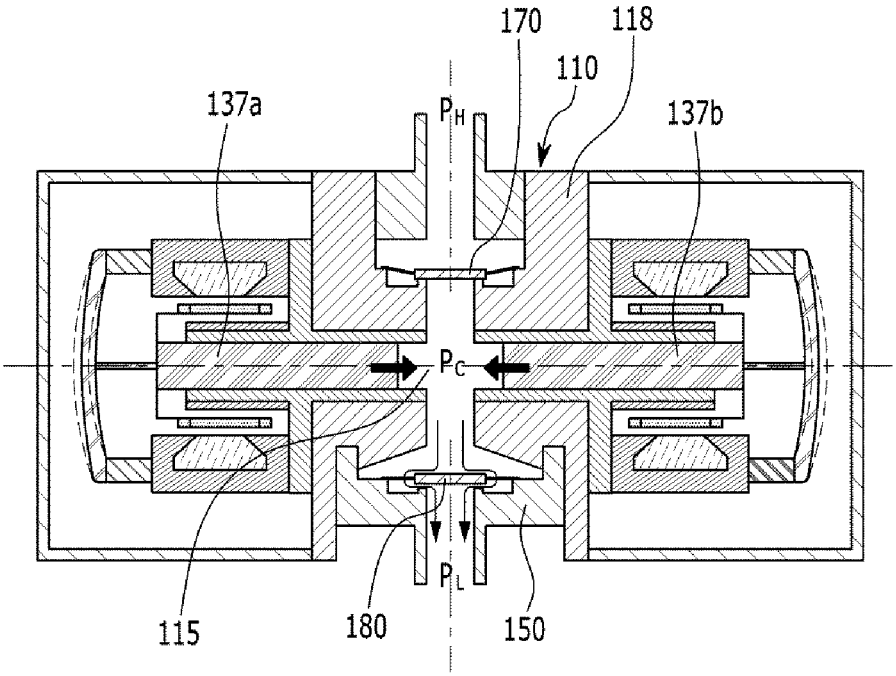
FIG. 5C is a cross-sectional view illustrating the linear expander according to the exemplary embodiment of the present invention in an isobaric discharge process from point 3 to point 4 in the p-v line of FIG. 4A.
Figure 5D:
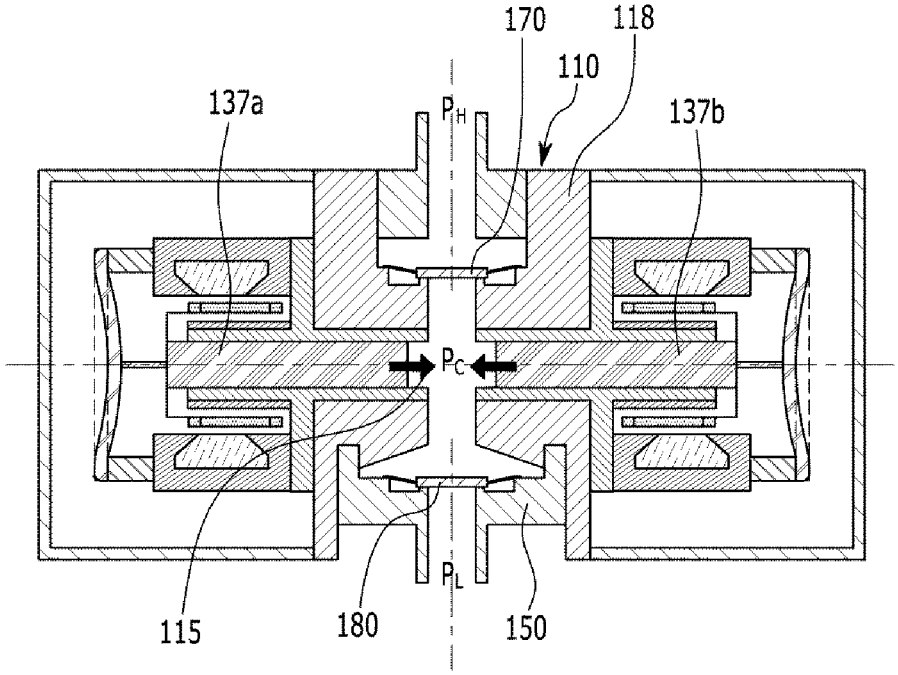
FIG. 5D is a cross-sectional view illustrating the linear expander according to the exemplary embodiment of the present invention in an adiabatic compression process from point 4 to point 1 in the p-v line of FIG. 4A.

FIG. 5A is a cross-sectional view illustrating the linear expander according to the exemplary embodiment of the present invention in the isobaric suction process from point 1 to point 2 in the p-v diagram of FIG. 4A, FIG. 5B is a cross-sectional view illustrating the linear expander in the adiabatic expansion process from point 2 to point 3 in the p-v line of FIG. 4A, FIG. 5C is a cross-sectional view illustrating the linear expander in the isobaric discharge process from point 3 to point 4 in the p-v line of FIG. 4A, and FIG. 5D is a cross-sectional view illustrating the linear expander in the adiabatic compression process from point 4 to point 1 in the p-v line of FIG. 4A.

First, FIG. 5A illustrates the isobaric suction process (1→2), and a system high-pressure $P_H$ formed in the outside of the suction hole 111 is maintained to be always be higher than a pressure $P_C$ of the expansion space 115. In this case, a pressure difference between the system high-pressure $P_H$ and the pressure $P_C$ of the expansion space 115 is reduced and thus the suction valve 170 maintains the opened state such that the high-pressure fluid flows into the body portion 110. As the high-pressure fluid flows in, the pistons 137*a* and 137*b* move to the outside in the bilateral directions respectively such that the pressure $P_C$ of the expansion space 115 can be maintained at a constant level. In this case, the pressure $P_C$ of the expansion space 115 is always higher than a system low pressure $P_L$ formed in the outside of the discharge hole 112, and a difference between the pressure $P_C$ and the system low pressure $P_L$ is too high such that the discharge valve 180 is being closed, and the high-pressure fluid flows into the body portion 110 from the system high pressure $P_H$ while stopping outflow of the fluid.

Next, as shown in FIG. 5B, the linear expander experiences the adiabatic expansion process (2→3), and the pressure $P_C$ of the expansion space 115 is reduced as the high-pressure gas having flowed into the expansion space 115 expands. Thus, a difference between the system high pressure $P_H$ and the pressure $P_C$ of the expansion space 115 is increased so that the suction valve 170 is closed. Although the pressure $P_C$ of the expansions space 115 is reduced, the difference between the system high pressure $P_H$ and the pressure $P_C$ of the expansion space 115 is still high so that the discharge valve 180 maintains the closed state. The pressure of the fluid reduces as the high-pressure fluid in the expansions space 115 expands, and thus the pistons 137*a* and 137*b* move to the outward in the bilateral directions respectively by the expansion force, and in such a process, the linear generators 139*a* and 139*b* can generate induced electromotive force.

Generated electricity may be exhausted by putting a load to work, but an additional charging system may be provided and charged by the electricity or the electricity may be used as a power source of other devices (e.g., a compressor).

Next, as shown in FIG. 5C, the linear expander experiences the isobaric discharge process (3→4), and since the pressure $P_C$ of the expansion space 115 is gradually decreased during the adiabatic expansion process, the pressure difference with the system low $P_L$ is gradually decreased, and when the pressure difference equals the predetermined value, the discharge valve 180 is opened such that the low-pressure fluid in the expansion space 115 flows out to the outside of the linear expander 100. When the fluid in the expansion space 115 flows out, the pressure $P_C$ of the expansion space 115 maintains a constant state and the pistons 137*a* and 137 move to the inside again from the bilateral sides, respectively. In this case, the suction valve 170 also maintains the closed state.

Next, as shown in FIG. 5D, the linear expander experiences the adiabatic compression process (4→1), and thus compression is started again by the movement of the pistons 137*a* and 137*b* and the suction valve 170 and the discharge valve 180 both maintain the closed state.

As described, the processes described with reference to FIG. 5A to FIG. 5D are performed during one cycle and such a cycle is repeated such that the high-pressure fluid having flowed into the linear expander 100 from the outside is expanded to change the high-pressure fluid to low-pressure fluid and the low-pressure fluid is continuously flows out to the outside of the linear expander 100.

In FIG. 5A to FIG. 5D, the suction valve 170 and the discharge valve 180 are formed as the reed valves 200 described with reference to FIG. 2 and FIG. 3, and various types of mechanical valves operated by a pressure difference and various electric valves operated by an electrical signal are also applicable.

Figure 6:
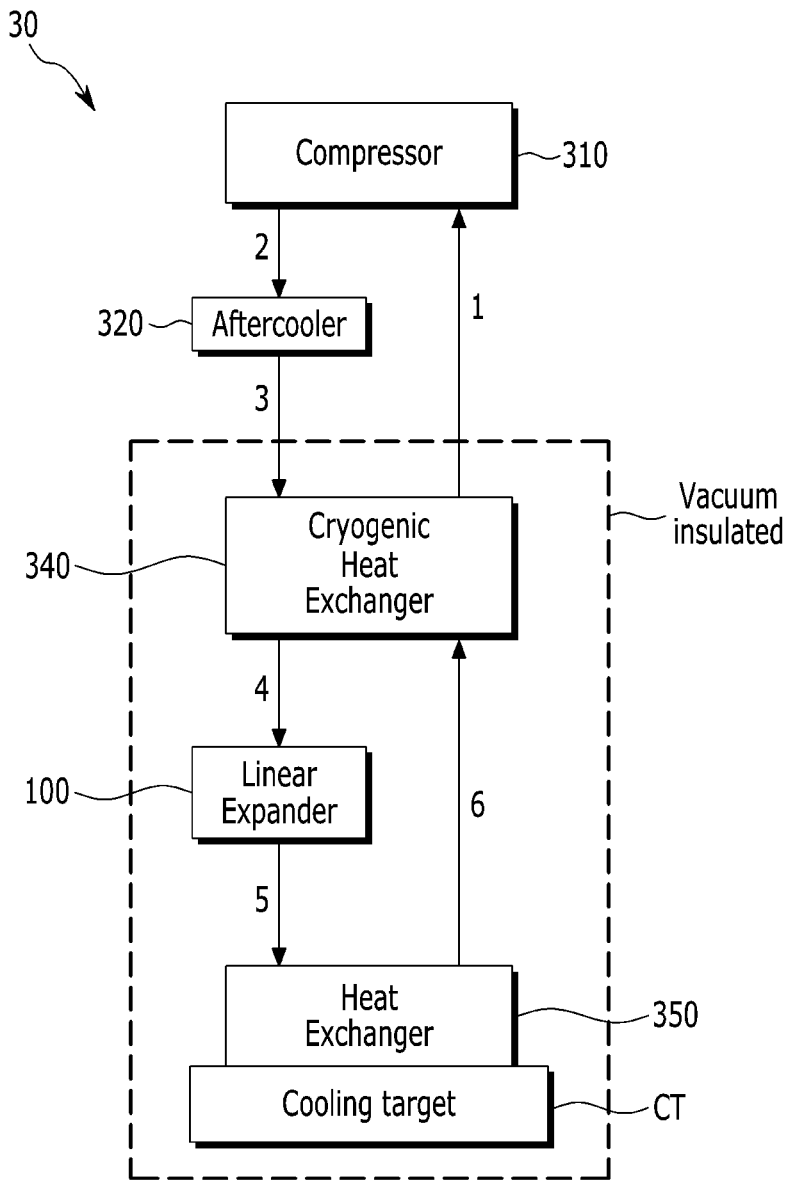
FIG. 6 is a schematic diagram illustrating a reverse Brayton cryogenic refrigeration system including a linear expander according to an exemplary embodiment of the present invention.
Figure 7:
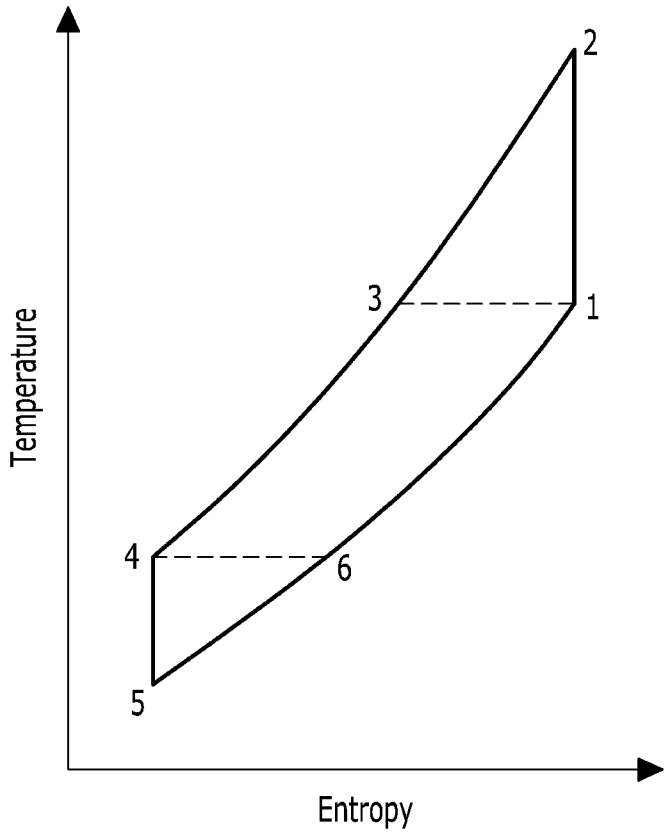
FIG. 7 is a T-s diagram of a reverse Brayton cryogenic refrigeration system shown in FIG. 6.

FIG. 6 is a schematic diagram illustrating a reverse Brayton cryogenic refrigeration system including a linear expander according to an exemplary embodiment of the present invention, and FIG. 7 is a T-s diagram of a reverse Brayton cryogenic refrigeration system shown in FIG. 6.

Referring to FIG. 6, the cryogenic refrigeration system 30 includes a compressor 310, a cryogenic heat exchanger 340, a linear expander 100, and a heat exchanger 350, and may cool or maintain a cooling target CT to a very low temperature by circulating refrigerant capable of transferring heat. For example, the cryogenic refrigeration system 30 may be used for cooling a superconducting cable to less than −200° C. such that the superconducting cable can be maintained as a superconducting state.

A compressor 310 compresses a gaseous refrigerant, and an aftercooler 320 fluidly communicates with an outlet of the compressor 310 such that the aftercooler 320 may remove compression heat generated during compressing the refrigerant. The cryogenic heat exchanger 340 fluidly communicates with an outlet of the aftercooler 320, and the cryogenic heat exchanger 340 may transfer the heat of the refrigerant passed through the aftercooler 320 to the refrigerant flowing into the compressor 310.

A linear expander 100 fluidly communicates with an outlet of the cryogenic heat exchanger 340 such that the linear expander 100 may receive and expand the refrigerant passed through the cryogenic heat exchanger 340. The linear expander explained in reference to FIG. 1 through FIG. 5D may be used for the linear expander 100 of the cryogenic refrigeration system 30. A counter flow type cryogenic heat exchanger may be used for the cryogenic heat exchanger 340 of the cryogenic refrigeration system 30. In the counter flow type cryogenic heat exchanger, high temperature high pressure gas and low temperature low pressure gas exchange heat while flowing in directions opposite to each other.

The heat exchanger 350 fluidly communicates with an outlet of the linear expander 100 and an inlet of the cryogenic heat exchanger 340. The heat exchanger 350 contacts with the cooling target CT, and may transfer heat from the cooling target CT to the refrigerant. The cooling target CT may be a solid matter or a fluid including liquid and gas.

Referring to FIGS. 6 and 7, an operating process of the cryogenic refrigeration system according to the embodiment will be explained below.

The compressor 310 compresses low pressure gaseous refrigerant (1→2), and the aftercooler 320 removes compression heat generated during compressing the refrigerant (2→3), and then the cryogenic heat exchanger 340 cools the refrigerant with low pressure low temperature gas (3→4). The high pressure gaseous refrigerant expands to a low pressure and works outward to drop the temperature (4→5), and then the temperature of the gaseous refrigerant goes up to some extent while cooling the cooling target CT contacting the heat exchanger 350 (5→6). The cryogenic heat exchanger 340 cools high pressure high temperature gaseous refrigerant (6→1), and then the refrigerant flows again into the compressor 310.

In FIG. 6, the process of 3→4→5→6→1 is operated at a temperature lower than room temperature and thus may be vacuum insulated to prevent heat invasion from outside.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

<Description of symbols>

| | |
|---|---|
| 100: linear expander | 110: body portion |
| 111: suction hole | 112: discharge hole |
| 113: first hole | 114: second hole |
| 115: expansion space | 130a: first linear generating portion |
| 130b: second linear generating portion | |
| 131a, 131b: external stator | |
| 132a, 132b: coil | 133a, 133b: internal stator |
| 135a, 135b: piston connection member | |
| 136a, 136b: elastic member | |
| 137a, 137b: piston | 138a, 138b: cylinder |
| 139a, 139b: linear generator | 150: discharge hole connection member |
| 152: protrusion | |
| 160: suction hole connection member | 170: suction valve |
| 180: discharge valve | 190: housing |
| 200: reed valve | 210: stopper portion |

-continued

<Description of symbols>

| | |
|---|---|
| 220: reed portion | |
| 30: cryogenic cooling system | 310: compressor |
| 320: aftercooler | 340: cryogenic heat exchanger |
| 350: heat exchanger | CT: cooling target |

What is claimed is:

1. A linear expander comprising:

a body portion comprising a suction hole through which a fluid having a first pressure flows in, a discharge hole through which the fluid flows out with a second pressure that is lower than the first pressure, and first and second holes connecting an expansion space formed between the suction hole and the discharge hole;

a first linear generating portion and a second linear generating portion comprising pistons respectively provided in the first hole and the second hole, the pistons being capable of linearly reciprocating to generate an induced electromotive force with an expansion force generated when the fluid having the first pressure expands to the fluid having the second pressure;

a suction valve opening and closing the suction hole; and a discharge valve opening and closing the discharge hole, wherein the suction valve and the discharge valve configured to be opened when no external force is applied and closed when a pressure force from a pressure difference becomes greater than a predetermined value, and wherein the suction valve and the discharge valve are passive valves and respectively formed as reed valves, wherein the suction valve is configured to close to prevent inflow of the fluid having the first pressure when a pressure in the expansion space is reduced and thus a pressure difference between the outside of the suction hole and the expansion space is greater than a predetermined value, and the discharge valve is configured to open to let the fluid in the expansion space to flow out when the pressure in the expansion space is reduced and thus a pressure difference between the outside of the discharge hole and the expansion space is lower than a predetermined value, wherein the body portion includes a body member having the expansion space and a discharge hole connection member combined with the body member to form a space between the expansion space and the discharge hole, wherein the discharge hole connection member has a through-hole that forms the discharge hole, and wherein the discharge valve is provided on the discharge hole connection member at an end of the through-hole.

2. The linear expander of claim 1, wherein the first hole and the second hole are symmetrical to each other on the same straight line with respect to the expansion space, and the first linear generating portion and the second linear generating portion are provided symmetrically to each other in the lateral sides of the body portion.

3. The linear expander of claim 1, wherein the discharge valve comprises:

a stopper portion stopping the end of the through-hole that faces the expansion space; and reed portions connected to the stopper portion and providing an elastic force to close and open the stopper portion by a pressure difference between a front side and a rear side of the stopper portion.

4. The linear expander of claim 1, wherein the suction valve comprises:

a stopper portion stopping the suction hole; and reed portions connected to the stopper portion and providing an elastic force to close and open the stopper portion by a pressure difference between a front side and a rear side of the stopper portion.

5. The linear expander of claim 1, wherein each of the first linear generating portion and the second linear generating portion further comprises:

a cylinder inserted to the first hole or the second hole formed in the body portion to provide a movement path of the piston; and a linear generator generating an induced electromotive force by movement of the piston.

6. The linear expander of claim 5, wherein each of the first linear generating portion and the second linear generating portion further comprises an elastic member provided at a rear end of a piston connection member that connects an operator of the linear generator and the piston to make the operator move according to movement of the piston.

7. The linear expander of claim 1, wherein the suction hole and the discharge hole are respectively provided in a direction perpendicular to a straight line direction along which the piston moves.

8. The linear expander of claim 1, further comprising a housing fixed to an outer side of the body portion and closing and sealing the inside while surrounding the first linear generating portion and the second linear generating portion.

* * * * *